US009623934B2

(12) United States Patent
Kipp et al.

(10) Patent No.: US 9,623,934 B2
(45) Date of Patent: Apr. 18, 2017

(54) METHOD AND APPARATUS FOR REPLACING A TENDON FLEX BEARING ON A TENSION LEG PLATFORM

(71) Applicant: Seahorse Equipment Corporation, Houston, TX (US)

(72) Inventors: Robert Kipp, Fulshear, TX (US); Kent Davies, San Diego, CA (US)

(73) Assignee: Seahorse Equipment Corp, Houston, TX (US)

( * ) Notice: Subject to any disclaimer, the term of this patent is extended or adjusted under 35 U.S.C. 154(b) by 0 days.

(21) Appl. No.: 15/008,109

(22) Filed: Jan. 27, 2016

(65) Prior Publication Data

US 2016/0214686 A1 Jul. 28, 2016

Related U.S. Application Data

(60) Provisional application No. 62/108,353, filed on Jan. 27, 2015.

(51) Int. Cl.
*B63B 21/50* (2006.01)

(52) U.S. Cl.
CPC ..... *B63B 21/502* (2013.01); *B63B 2021/505* (2013.01)

(58) Field of Classification Search
CPC ..... B63B 21/502; B63B 2021/505
USPC ..... 405/223.1, 224.4
See application file for complete search history.

(56) References Cited

U.S. PATENT DOCUMENTS 4,784,529 A * 11/1988 Hunter ..... B63B 21/502 114/265
5,174,687 A * 12/1992 Dunlop ..... B63B 21/502 405/195.1
6,585,455 B1 * 7/2003 Petersen ..... E21B 19/006 166/355
7,914,234 B2 * 3/2011 Large ..... E21B 19/004 405/223.1
8,021,081 B2 * 9/2011 Crotwell ..... E21B 19/002 166/355

* cited by examiner

*Primary Examiner* — Frederick L Lagman
(74) *Attorney, Agent, or Firm* — Blank Rome LLP

(57) ABSTRACT

A method and apparatus for replacing a tendon flex bearing on a tension leg platform includes installing a tendon tensioning tool on the Length Adjustment Joint (LAJ) of a tendon and providing a supplemental buoyancy module on the tendon. The tendon tensioning tool is used to disengage the slips from the top tendon connector. The buoyancy of the supplemental buoyancy module may then be adjusted to support the tendon whereupon the tendon tensioning tool may be disengaged permitting removal and replacement of the tendon flex bearing. Following installation of the new (or refurbished) flex bearing, the steps of the procedure may be reversed to return the tendon to its normal operating state. In certain embodiments, top clamp actuation means is provided in the tendon tensioning tool for removing slips from the top clamp.

18 Claims, 3 Drawing Sheets

METHOD AND APPARATUS FOR REPLACING A TENDON FLEX BEARING ON A TENSION LEG PLATFORM

CROSS-REFERENCE TO RELATED APPLICATIONS

This application claims the benefit of U.S. Provisional Application No. 62/108,353, filed on Jan. 27, 2015, the contents of which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention generally relates to floating platforms for the offshore production of oil and gas. More particularly, it relates to tension leg platforms (TLPs).

2. Description of the Related Art Including Information Disclosed Under 37 CFR 1.97 and 1.98

The tendon flex bearing is a structural element that allows for relative rotation between the top of the tendon and the tendon porch, i.e. the TLP hull. The tendon flex bearing is in the direct load path of the primary station keeping forces. A typical TLP full life-cycle operational plan does not call for the replacement of these elements.

Station keeping of a typical TLP is provided by a minimum of six tendons. A TLP is designed for extreme and survival conditions, as well as for conditions wherein one tendon missing (i.e., the TLP is re-ballasted to maintain proper tendon tension) and for a broken tendon condition (i.e., no immediate ballast compensation). Though the TLP is designed for such conditions, remedial actions are generally not developed as part of the design process.

Piles driven into the seafloor are attached to the lower ends of the tendons. The upper end of the tendon connects to the TLP hull. The upper end of the tendon itself comprises tendon body elements and, above such, a length adjustment joint (LAJ). The diameter of the LAJ is generally smaller than the diameter of the tendon body. A section of the LAJ is equipped with concentric grooves which allow slips having corresponding projections to clamp onto the tendon (LAJ). These slips, called "the clamp," are supported by the flex bearing. The flex bearing allows for differential rotation between the tendon body and TLP. The flex bearing may be supported by a load ring which is supported by load cells used to measure the tendon tension. The load cells may be supported by a second load ring that is rigidly attached to the tendon porch which is connected to TLP hull. Alternatively, some TLPs are configured such that the tendon flex bearing is supported directly on the tendon porch or on a ring on the tendon porch. Most of these devices are circular in cross section and, when installed, have a common longitudinal axis. As such, the LAJ (and tendon) are at the center and protrude vertically through the centers of the clamp, the flex bearing, the centers of both load rings and the geometric center of the load cells. FIG. 1 illustrates a typical layout of a tendon and its associated flex bearing.

BRIEF SUMMARY OF THE INVENTION

The methodology and hardware disclosed herein enables the in situ replacement of a tendon flex bearing on a tension leg platform.

The challenge with replacing a flex bearing is to remove this element from the primary load path under in-situ conditions in a cost-efficient manner while assuring platform integrity and safety. Replacing the flex bearing requires the following steps:

A. releasing the clamp from the LAJ;
B. removing the clamp;
C. removing the flex bearing;
D. installing a new (repaired or refurbished) flex bearing;
E. reinstalling the clamp; and,
F. securing the clamp to the LAJ.

Typically, the pretension in each of the tendons is approximately one-third to one-half the maximum allowable load. One cannot simply release the clamp (as stated in step A, above). The tension in the tendon (at the clamp) must first be significantly reduced. However, the tension must remain sufficient to prevent any buckling of the tendon. Furthermore, the clamp cannot be unloaded by applying a load to the top of the LAJ, because the configuration does not allow for the existing flex bearing to be removed and a new one to be installed (due to interference issues).

In a method according to the invention, a supplemental buoyancy module is attached to the tendon and its buoyancy is adjusted to apply a force greater than the in-water weight of the tendon.

A tendon tensioning tool is used to disengage the slips from the top tendon connector. The buoyancy of the supplemental buoyancy module supports the tendon whereupon the tendon tensioning tool may be disengaged permitting removal and replacement of the tendon flex bearing.

BRIEF DESCRIPTION OF THE SEVERAL VIEWS OF THE DRAWING(S)

DETAILED DESCRIPTION OF THE INVENTION

Figure 1:
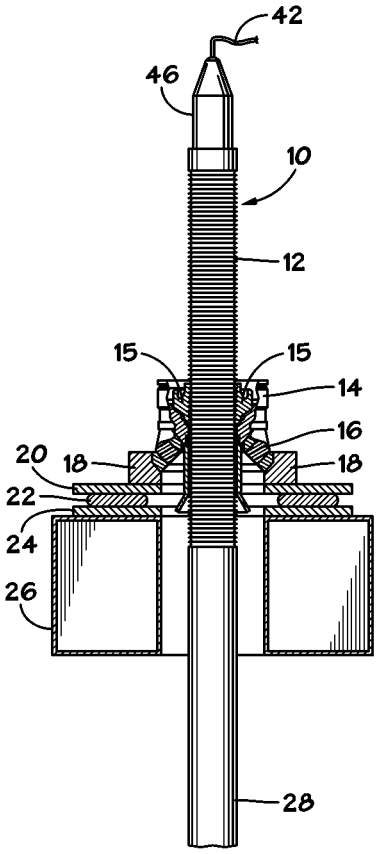
FIG. 1 (prior art)
FIG. 1 is a schematic view, partially in cross section, of the upper portion of a TLP tendon together with its associated tendon porch and top tendon connector in its normal operating condition.

Herein, a method is disclosed for replacing a tendon flex bearing on an installed TLP.

The invention may best be understood by reference to the drawing figures wherein one particular method according to the invention is shown sequentially. In the drawing figures, the following reference numbers are used to designate the listed elements:

10 length adjustment joint (LAJ)
12 LAJ grooves

14 clamp
15 slips
16 flex bearing
18 flex bearing base
20 upper load ring
22 load cell
24 lower load ring
26 tendon porch
28 tendon body
30 tendon tensioning tool
32 hydraulic cylinders
34 hydraulic rams
36 plate
40 supplemental buoyancy module
42 messenger line
44 spacer
46 messenger line adapter
48 tendon top connector Referring to FIG. 1, an installed tendon 28 is shown secured in its normal operating state to tendon porch 26 of a TLP (not shown). Upper portion 10 of tendon 28 comprises the length adjustment joint (LAJ) which may have a reduced diameter relative to the main body portion of tendon 28. LAJ grooves 12 are provided in a portion of the outer surface of LAJ 10 to engage slips 15 in clamp 14. Clamp 14 bears against flex bearing 16 supported on flex bearing base 18. Flex bearing base 18 bears against upper load ring 20 which bears against load cell 22 supported on lower load ring 24 so as to provide a measure of the tension in tendon 28. It will be appreciated that this is merely an exemplary configuration and other configurations used in the industry may also employ the method of the invention. For example, in some configurations, the load cell is incorporated into the body of the tendon; in yet other configurations, the flex bearing is supported directly on the tendon porch.

Together, clamp 14, flex bearing 16 and base 18 comprise tendon top connector 48.

Figure 2:
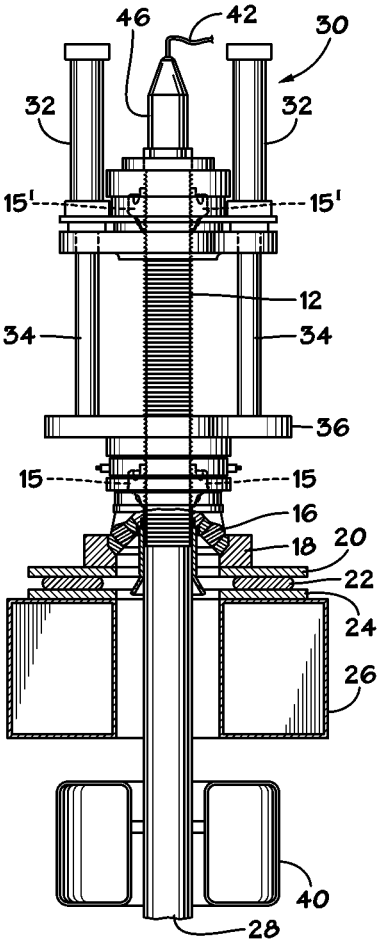
FIG. 2 is a schematic view, partially in cross section, of the apparatus shown in FIG. 1 with a tendon tensioning tool installed and a supplemental buoyancy module attached to the tendon.

In FIG. 2, the tendon assembly shown in FIG. 1 is illustrated with tendon tensioning tool 30 attached. Messenger line 42 (connected to the LAJ via messenger line adapter 46) may assist in the installation of tendon tension tool 30 on LAJ 10 of tendon 28. As will be appreciated by those skilled in the art, the apparatus illustrated in the drawing figures is below the waterline of the TLP on which it is installed. Accordingly, messenger line 42 may act to guide tendon tensioning tool 30 during installation and removal.

Tendon tensioning tool 30 comprises hydraulic cylinders 32 containing hydraulic rams 34 which act against plate 36 so as to apply additional tension to tendon 28—i.e., more tension than that due to the buoyancy of the TLP applied via the load path comprising tendon porch 26, lower load ring 24, load cell 22, upper load ring 20 and flex bearing 16. The net result of the additional tension applied by tendon tensioning tool 30 is a reduction in the load borne by the top connector slips 15.

The upper portion of tendon tensioning tool 30 temporarily functions as a tendon top connector during portions of the process.

Also shown in FIG. 2 is removable supplemental buoyancy module 40 attached to tendon 28 at a point below tendon porch 26. In certain embodiments, supplemental buoyancy module 40 has means for adding or releasing a gas (which may be air) to displace or admit water into the interior chamber(s) of supplemental buoyancy module 40 thereby adjusting its buoyancy.

In certain embodiments, top clamp actuation means for the top clamp is provided in the tendon tensioning tool. Top clamp actuation tools of the prior art normally fit in the same interface area where the tendon tensioning tool must react on the top of the top clamp body. This makes use of both an actuation tool and a tendon tensioning tool at same time impossible. Providing top clamp actuation means in the tendon tensioning tool overcomes this problem.

The exemplary, illustrated embodiment of the invention comprises the following steps:

Step 1: Supplemental buoyancy module 40 is attached to tendon 28 undergoing flex bearing 16 replacement; [this state is illustrated in FIG. 2]

Figure 3:
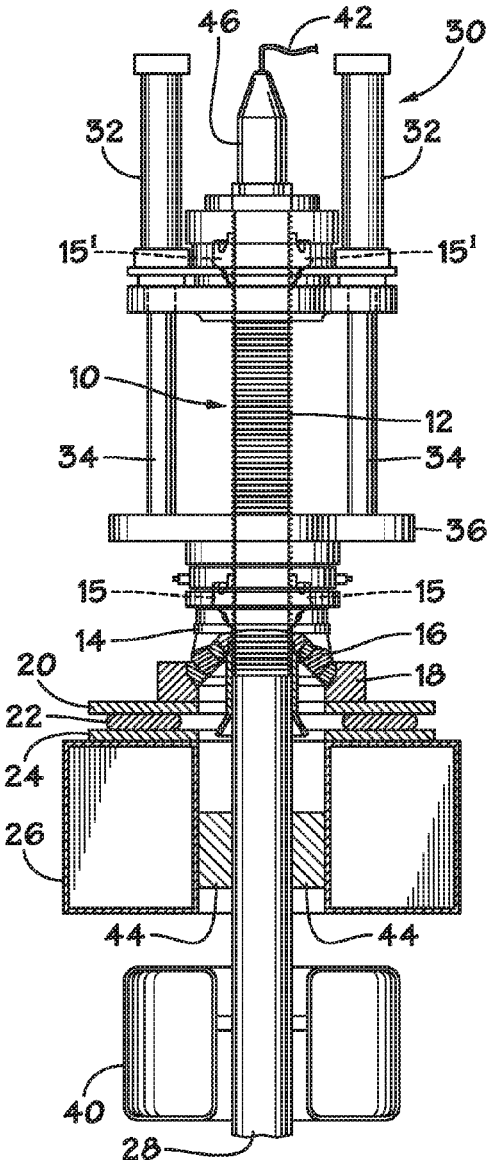
FIG. 3 is a schematic view, partially in cross section, of the apparatus shown in FIG. 2 with an annular spacer installed between the tendon and the inner surface of the tendon porch.

Step 2: Air is added to buoyancy module 40 to take/apply force greater than the in-water weight of tendon 28;

Step 3: The buoyancy of the TLP is adjusted to reduce the tendon tension in the tendons at the particular corner of the TLP at which flex element replacement is required;

Step 4: Tension is applied to the tendon (undergoing flex element removal) between the top of the exposed tendon top and the top of the tendon top connector, using tendon tensioning tool 30;

Step 5: The tendon top connector 48 is unlatched;

Step 6: A temporary spacing device 44 is inserted between tendon 28 and the interior of tendon porch 26 (to keep tendon 28 from rubbing on porch 26 while the top clamp is removed; [this state is illustrated in FIG. 3]

Figure 5:
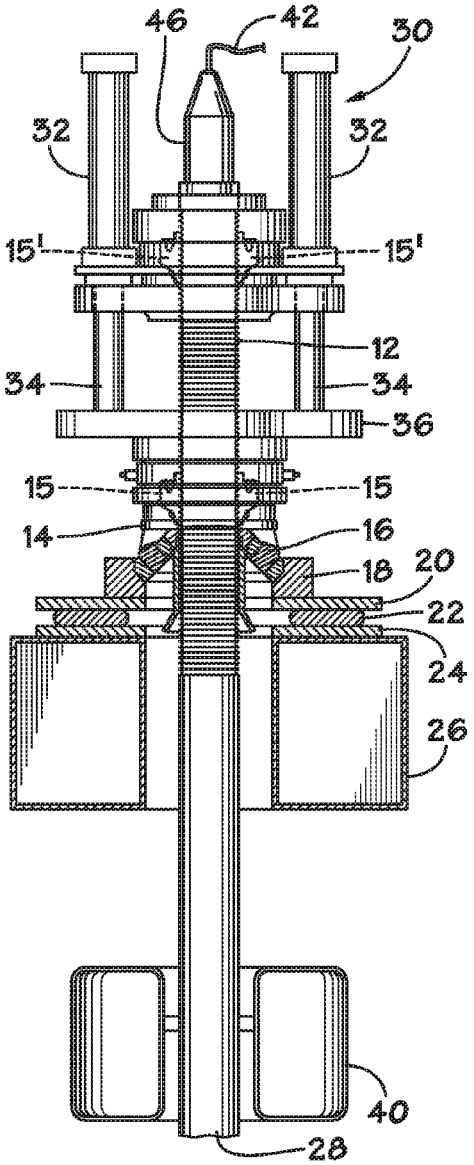
FIG. 5 is a schematic view, partially in cross section, showing the tendon tensioning tool retracted and disengaged, allowing the tendon weight to be carried by the supplemental buoyancy module. In this state, the tendon tensioning tool may be released and can be lifted off the tendon.

Step 7: The tendon top tension is reduced by slacking off on tendon tensioning tool 30 until weight in water of tendon 28 carried by buoyancy module 40; [this state is illustrated in FIG. 5]

Figure 4:
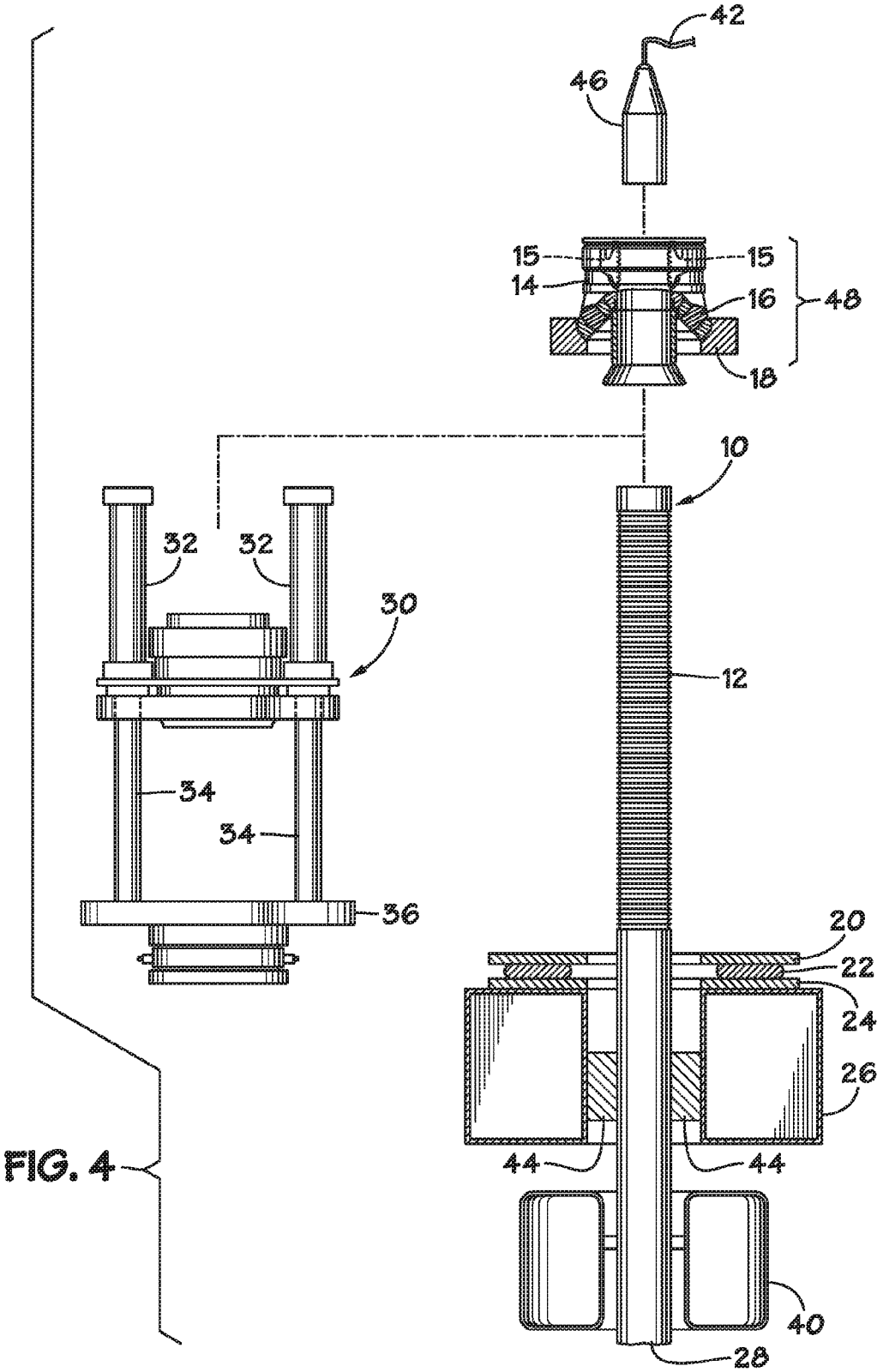
FIG. 4 is an exploded, schematic view, partially in cross section, of the apparatus shown in FIGS. 2 and 3.

Step 8: Tensioning tool 30 is removed; the tendon top connector is removed and flex element 16 is replaced; [this state is illustrated in FIG. 4]

Step 9: The tendon top connector (or, alternatively, a replacement top connector) is placed onto tendon porch 26 (with the replacement flex bearing 16);

Step 10: Tendon tensioning tool 30 is installed; tension is applied to tendon 28 by reacting against the top of the tendon top connector;

Step 11: Temporary spacing device 44 is removed;

Step 12: Air is released from supplemental buoyancy module 40;

Step 13: The tendon tension is adjusted with tensioning tool 30 to match adjacent tendon(s) and the tendon top clamp is engaged; [starting position shown in FIG. 5]

Step 14: Supplemental buoyancy module 40 is removed;

Step 15: The tendon tension is checked and tendon tension reapplied with tensioning tool 30 and adjustment of the top clamp, if necessary; and, Step 16: Tendon tensioning device 30 is removed. [returning the system to the state illustrated in FIG. 1]

The foregoing presents particular embodiments of a system embodying the principles of the invention. Those skilled in the art will be able to devise alternatives and variations which, even if not explicitly disclosed herein, embody those principles and are thus within the scope of the invention. Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A method for replacing a tendon flex bearing on a tension leg platform (TLP) having a tendon with a length adjustment joint (LAJ) secured to a tendon porch on the TLP by means of a top clamp having releasable slips comprising:

installing a tendon tensioning tool on the LAJ;

attaching a supplemental buoyancy module to the tendon;

applying tension to the tendon with the tendon tensioning tool sufficient to release the slips from the top clamp;

adjusting the buoyancy of the supplemental buoyancy module;

releasing tension applied to the tendon with the tendon tensioning tool;

removing the tendon tensioning tool from the LAJ; and, removing the tendon flex bearing.

2. The method recited in claim 1 wherein installing the tendon tensioning tool on the LAJ comprises installing the tendon tensioning tool above the top clamp.

3. The method recited in claim 1 wherein attaching the supplemental buoyancy module to the tendon comprises attaching the supplemental buoyancy module below the tendon porch.

4. The method recited in claim 1 wherein adjusting the buoyancy of the supplemental buoyancy module comprises increasing the buoyancy of the supplemental buoyancy module sufficiently to support the tendon substantially vertically in the sea.

5. The method recited in claim 1 further comprising installing a spacer between the tendon and the tendon porch.

6. The method recited in claim 5 wherein the spacer is an annular spacer.

7. The method recited in claim 1 wherein installing a tendon tensioning tool on the LAJ comprises installing a messenger line on the LAJ.

8. The method recited in claim 1 wherein the tendon tensioning tool comprises an actuation tool configured to disengage the slips from the length adjustment joint.

9. The method recited in claim 1 wherein the tendon tensioning tool comprises at least one hydraulic cylinder.

10. The method recited in claim 9 further comprising monitoring the tension applied to the tendon by the tendon tensioning tool by measuring the pressure within the at least one hydraulic cylinder.

11. The method recited in claim 1 further comprising:

adjusting the buoyancy of the TLP to reduce the tension in the tendon.

12. The method recited in claim 1 further comprising:

reducing the tendon tension by slacking off the tendon tensioning tool until the in-water weight of the tendon is borne by the supplemental buoyancy module.

13. The method recited in claim 1 further comprising:

reinstalling the tendon tensioning tool after replacement of the flex bearing; and, applying tension to the tendon by reacting the tendon tensioning tool against the top clamp.

14. The method recited in claim 13 further comprising:

decreasing the buoyancy of the supplemental buoyancy module.

15. The method recited in claim 14 further comprising:

adjusting the tendon tension using the tendon tensioning tool to substantially equal the tension in an adjacent tendon.

16. The method recited in claim 15 further comprising:

removing the supplemental buoyancy module;

reapplying tension to the tendon using the tendon tensioning tool; and, adjusting the top clamp.

17. The method recited in claim 15 further comprising:

removing the supplement buoyancy module; and, removing the tendon tensioning tool.

18. The method recited in claim 17 wherein removing the tendon tensioning tool comprises guiding the tendon tensioning tool with a messenger line attached to the tendon.

* * * * *